US005725755A

United States Patent [19]

Forbus

[11] Patent Number: 5,725,755

[45] Date of Patent: Mar. 10, 1998

[54] CATALYTIC DEWAXING PROCESS FOR THE PRODUCTION OF HIGH VI LUBRICANTS IN ENHANCED YIELD

[75] Inventor: T. Reginald Forbus, Newton, Pa.

[73] Assignee: Mobil Oil Corporation, Fairfax, Va.

[21] Appl. No.: 536,012

[22] Filed: Sep. 28, 1995

[51] Int. Cl.[6] ..... C10G 45/58

[52] U.S. Cl. ..... 208/27; 208/18; 208/19

[58] Field of Search ..... 208/27, 18, 19

[56] References Cited

U.S. PATENT DOCUMENTS

| | | | |
|---|---|---|---|
| 4,181,598 | 1/1980 | Gillespie | 208/58 |
| 4,222,855 | 9/1980 | Pelrine et al. | 208/18 |
| 4,259,170 | 3/1981 | Graham | 208/33 |
| 4,372,839 | 2/1983 | Oleck et al. | 208/18 |
| 4,383,913 | 5/1983 | Powell et al. | 208/18 |
| 4,844,829 | 7/1989 | Wilburn et al. | 508/469 |
| 4,975,177 | 12/1990 | Garwood et al. | 208/27 |
| 5,264,116 | 11/1993 | Apelian et al. | 208/27 |
| 5,288,395 | 2/1994 | Marler et al. | 208/27 |
| 5,292,426 | 3/1994 | Holland et al. | 208/27 |
| 5,488,191 | 1/1996 | Chu et al. | 585/10 |
| 5,543,035 | 8/1996 | Ziemer | 208/58 |

FOREIGN PATENT DOCUMENTS 426841 4/1994 European Pat. Off. .

*Primary Examiner*—Walter D. Griffin
*Attorney, Agent, or Firm*—Penny L. Prater; Malcolm D. Keen

[57] ABSTRACT

A catalytic hydrodewaxing process is described for producing liquid hydrocarbon lubricant base stock from liquid hydrocarbon feedstock in greater yield and viscosity index equivalent to solvent dewaxing methods. The process involves contacting a feedstream comprising hydrogen and the hydrocarbon feedstock with shape selective metallosilicate catalyst particles under hydrodewaxing conditions sufficient to produce a base stock having a predetermined viscosity index without regard to the base stock pour point temperature produced by the process. Pour point depressants are added to the base stock to lower the pour point temperature of the base stock to a predetermined temperature.

8 Claims, 3 Drawing Sheets

PPD & VII OF HYDRODEWAXED 100N BASESTOCK BY C6-C20 MIXED OCP-PPD

PPD & VII OF HYDRODEWAXED 700N BASESTOCK BY C6-C20 MIXED OCP-PPD

PPD & VII OF HYDRODEWAXED 700N BASESTOCK BY HIGH VISCOSITY HVI-PAO BASESTOCK

CATALYTIC DEWAXING PROCESS FOR THE PRODUCTION OF HIGH VI LUBRICANTS IN ENHANCED YIELD

FIELD OF THE INVENTION

This invention relates to an improved process for the production of hydrocarbon lubricants from mineral oil. The invention specifically relates to an improved process for dewaxing raffinates to a predetermined viscosity index (VI) which directly provides hydrocarbon lubricant base stock in greater yield and viscosity index.

BACKGROUND OF THE INVENTION

Lubricating oils for the most part are based on petroleum fractions boiling above about 232 degrees C. (450 degrees F.). The molecular weight of the hydrocarbon constituents is high and these constituents display almost all conceivable structures and structure types depending in large part on the type of crude oil from which they were prepared.

The rational in lubricant refining is that a suitable crude oil, as shown by experience or by assay, contains a quantity of lubricant base stock having a predetermined set of properties such as, for example, appropriate viscosity, oxidation stability, and maintenance of fluidity at low temperatures. The refining process imposed to isolate that lubricant base stock currently consists of a set of subtractive unit operations which remove the unwanted components. The most important of these unit operations include distillation, solvent refining, and dewaxing, which basically, except for catalytic dewaxing, are physical separation processes in the sense that if all the separated fractions were recombined one would reconstitute the crude oil.

A lubricant base stock (i.e. a refined oil) may be used as such as a lubricant, or it may be blended with another lubricant base stock having somewhat different properties. The base stock, prior to use as a lubricant, may also be compounded with one or more additives such as antioxidants, extreme pressure additives, and viscosity index (V.I.) improvers. As used herein, the term "stock," regardless whether or not the term is further qualified, will refer only to a hydrocarbon oil without additives. The term "solvent-refined stock" or "raffinate" will refer to an oil that has been solvent extracted, for example with furfural. The term "dewaxed stock" will refer to an oil which has been treated by any method to remove or otherwise convert the wax contained therein and thereby reduce its pour point. The term "waxy," as used herein, will refer to an oil of sufficient wax content to result in a pour point greater than −4 degrees C. (+25 degrees F.). The term "base stock" will refer to an oil refined to a point suitable for some particular end use, such as for preparing automotive oils.

The current practice for the preparation of high grade lubricating oil base stocks is to vacuum distill an atmospheric tower residuum from an appropriate crude oil as the first step. This step provides one or more raw stocks within the boiling range of about 288 degrees C. (550 degrees F.) to 565 degrees C. (1050 degrees F.) and a vacuum residuum. After preparation, each raw stock is extracted with a solvent, e.g. furfural, phenol or chlorex, which is selective for aromatic hydrocarbons, and which removes undesirable components. The vacuum residuum usually requires an additional step to remove asphaltic material prior to solvent extraction. The raffinate from solvent refining is then catalytically dewaxed.

U.S. Pat. No. Re. 28,398 describes a process for catalytic dewaxing with a catalyst comprising zeolite ZSM-5. Such a process combined with catalytic hydrofinishing is described in U.S. Pat. No. 3,894,938. Catalyst dewaxing of raffinate using zeolite catalyst such as ZSM-5 is further described in U.S. Pat. Nos. 4,181,598 and 4,259,170, the entire contents of which are incorporated herein by reference.

The manufacture of lube oil base stocks is designed to produce a product according to very strict specifications for pour point, viscosity, viscosity index (V.I.) and product flash point. Often, improvements in one or more of these product parameters can be achieved only by adversely affecting other product parameters or at the expense of the overall yield of useful product. However, if improvements can be realized in the specification for viscosity index, for instance, without deleteriously affecting the achievable specification for the remaining product parameters very substantial economic benefits can accrue to the process of manufacturing of lube oil stock. If an improvement in the downstream processing of the lube oil cut from a crude oil can be improved to produce a lube oil stock with one or more properties exceeding the required specifications, the refinery operator is left with a variety of options on how to exploit the improved performance, all of which lead to a betterment of the economic performance of the refinery.

The art of lube base stock production is generally carried out by dewaxing raffinates by solvent dewaxing or catalytic dewaxing under conditions which produce a predetermined or target pour point for the base stock. Suitable materials are then added to the base stock to augment the base stock properties and meet the requires specification, such as viscosity index. In catalytic dewaxing of raffinates to useful base stock having a predetermined pour point produced over medium pore zeolite catalysts, such as ZSM-5, viscosity indices (VIs) generally suffer substantial debits relative to solvent dewaxing.

It is an object of the present invention to provide an improvement to the process of manufacturing lube oil stock leading to the enhancement of the yield and viscosity index for the stock as produced by catalytic dewaxing.

It is a further object of the present invention to provide the aforenoted improvements while providing a base stock that meets the prevailing specification for base stock having a low pour point.

SUMMARY OF THE INVENTION

An integrated discovery has been made that reveals a method to carry out catalytic dewaxing of raffinate that both reduces the sharp loss of viscosity index attendant upon the process of the prior art while increasing the yield of lube base stock produced by catalytic dewaxing. Where in the prior art catalytic dewaxing of raffinate has been performed to produce a lube base stock of a targeted or predetermined pour point without regard to the consequential loss in viscosity index, it has been discovered that a greatly improved catalytic dewaxing process is realized when dewaxing is conducted to produce a base stock of predetermined or targeted high viscosity index, without regard to the resultant pour point of the base stock. This is the first independent element of the discovery. The second independent element is the finding that the high VI base stock product of targeted VI processing which typically has an unacceptably high pour point can be treated with certain particularly effective pour point depressants to provide a lube base stock of low pour and high VI in greater yield than targeted pour point processing.

More particularly, the invention comprises a catalytic hydrodewaxing pour point temperature reduction process for producing liquid hydrocarbon lubricant base stock from liquid hydrocarbon feedstock in greater yield and viscosity index equivalent to solvent dewaxing methods. The process comprises contacting a feedstream comprising hydrogen and the feedstock with shape selective metallosilicate catalyst particles in a catalytic hydrodewaxing zone under hydrodewaxing conditions. The conditions are those which are sufficient to produce a base stock having a predetermined high viscosity index without regard to the base stock pour point temperature produced. The base stock is produced at an elevated viscosity index and in greater yield compared to catalytic dewaxing to a predetermined low pour point.

Preferably the product of targeted VI dewaxing is mixed with pour point depressant (PPD) additives to lower the pour point value of said base stock to a specified pour point temperature. The PPD additives preferably comprise the copolymer residue of a mixture of 1-alkene comonomers selected from the group consisting of $C_3$–$C_{28}$ 1-alkenes. The copolymer contains at least 10 weight percent of recurring monomeric units of $C_{14}$–$C_{24}$ 1-alkenes; has a number average molecular weight between 5,000 and 60,000; and a molecular weight distribution between 1 and 10.

The process of the invention is effectively applicable to any raffinate produced from a petroleum crude oil that is useful as a resource for hydrocarbon lubricant production. However, certain heavy raffinates derived from certain crudes have been found to benefit to a proportionally greater degree from the process of the invention since they are known to suffer a disproportionate loss in VI and/or yield when dewaxed to a predetermined low pour point by prior art processes. Consequently, the process of the invention distinguishes these disadvantaged crude oils as now comprising a more competitive resource for lube base stock.

DETAILED DESCRIPTION OF THE INVENTION

Figure 1:
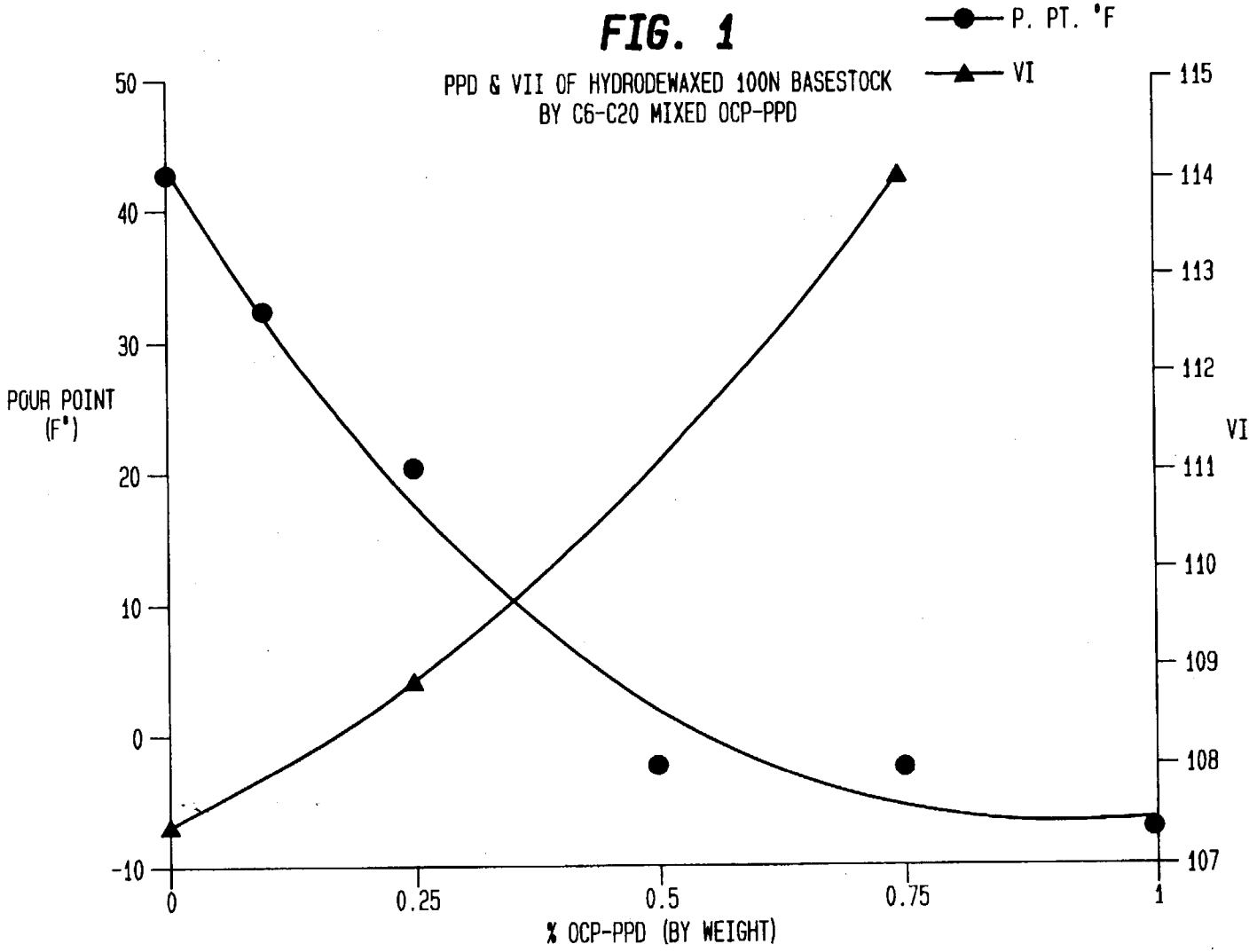
FIG. 1 is graphical presentation of the pour points and viscosity of hydrodewaxed 100N basestock of the invention containing pour points depressants comprising copolymers of mixed $C_6$–$C_{20}$ 1-alkenes.

The process of the invention involves the catalytic dewaxing of raffinates with HZSM-5 catalysts to produce a lube base stock having a desired viscosity index (VI) levels without regard for the pour point of the dewaxed base stock. The pour point is then reduced using polymeric additives derived from a family of olefin co-polymers alone and in combination with traditional ester-type polymers or co-polymers used for pour point suppression of normal pour point lubricant base stocks. Conversion of raffinate to higher pour point base stock in catalytic dewaxing increases the base stock yield and VI. Addition of the pour point depressants (PPD) adjusts the base stock pour point to levels desirable for low temperature applications. The process of the invention produces higher yields of lube base stock with improved natural temperature-viscosity properties (VI).

Generally, raffinates that are catalytically dewaxed to produce lubricant base stocks suffer some losses in yield and viscosity indices relative to base stocks obtained at similar pour point through solvent dewaxing. In catalytic dewaxing of raffinates to useful pour point base stocks over medium pore zeolite catalysts, such as ZSM-5, VIs generally suffer substantial debits relative to solvent dewaxing. With heavy feeds this problem cannot be easily or economically remedied by changes in upstream or downstream processing. The use of the process of the invention coupled with the application of effective pour point depressants described herein offers a technically and economically viable method to achieve improved yield and VI of neutral base stocks with pour points suitable for lubricants designed for low temperature operations. The novel process is especially applicable to heavy neutrals wherein smaller pore zeolites are incapable of lowering pour point to useful levels. However, the process is applicable to any mineral oil derived lube stock wherein the pour point is goverened by the wax content of the oil, whether a resid derived bright stock or distillate derived neutral stock.

In the preferred embodiments of this invention wax base crude oils, sometimes called paraffin base crude oils, are utilized to provide the raw charge stock from which lube oil base stock is produced. The wax base crudes represent a well organized class of crude petroleum. Crudes utilized to produce the raffinates processed according to the instant invention as reported herein include Arab Light crude and Isthmus crude. However, the process and invention described herein are applicable to a wide range of waxy crudes and not limited to the production of high viscosity index lube oil stock from Arab Light crude oil or Isthmus crude oil.

The specific invention described herein relates to an integrated dewaxing process comprising solvent refining, catalytic dewaxing over zeolite catalyst and hydrotreating. It will be well recognized by those skilled in the art that the process stages of solvent refining, catalytic dewaxing and hydrotreating are conventional except that in the present invention the catalytic dewaxing step is carried out until the product acquires a viscosity index of predetermined value. The predetermined VI value is higher than the VI which would result from catalytic dewaxing of the same crude to a predetermined low pour point.

The solvent extraction technique is well understood in the art and needs no detail review here. The severity of extraction is adjusted to the composition of the charge stock to meet specifications for the particular lube base stock in the contemplated end use; this severity will be determined in the practice of this invention in accordance with well established practices.

The catalytic dewaxing step is preferably conducted in contact with zeolite catalyst at temperatures of 500 degrees F. (269° C.) to 675 degrees F. (357° C.), liquid hourly space velocity (LHSV) of 0.1 to 5.0 based on catalyst; and a hydrogen partial pressure of 1,050 kPa to 10,500 kPa. At temperatures above about 357° C., bromine number of the product generally increases significantly and the oxidation stability decreases.

In the catalytic dewaxing step of the process olefins are produced and large waxing molecules in the charge are cracked producing lighter fractions that include light and heavy kerosene. As the presence of olefins would act to destabilize the lube oil base stock the catalytic dewaxing reaction products are cascaded into a hydrotreater containing, as catalyst, a hydrogenation component on a non-acidic support, such as cobalt-molybdate or nickel-molybdate on alumina. The catalytic dewaxing reaction effluent is hydrotreated in the broad range of 220° C. to 315° C.

The dewaxing catalyst is a composite of hydrogenation metal, preferably a metal of Group VIII of the Periodic Table, associated with the acid form of aluminosilicate zeolite having a silica/alumina ratio of at least about 12 and a constrained access to the intracrystalline free space, as more fully described herein below. The dewaxing catayst may also be metal-free in the sense that it is absent a hydrogenation metal but otherwise consists of an aluminosilicate zeolite. Hydrogenation metal free catalysts are well known in the art for dewaxing as described in European patent EP 426,841 to which reference is made for a description of hydrogenation metal-free zeolite dewaxing catalyst.

An important characteristic of the crystal structure of this class of zeolites is that it provides constrained access to and egress from the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The constrained access to the crystalline free space of the class of zeolites employed herein is conveniently measured by a "constraint index," which will have a value for any given zeolite of interest herein within the range of 1 to 12. The determination of "constraint index" is well known in the art as described in U.S. Pat. No. 4,181,598.

The class of zeolites defined herein is exemplified by ZSM-5, ZSM-11, ZSM-12, ZSM-22, ZSM-23, ZSM-35, ZSM-38, ZSM-48, ZSM-57, ZSM-58 and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-35 is more particularly described in U.S. Pat. No. 4,016,245, the entire contents of which is incorporated herein by reference.

ZSM-38 is more particularly described in U.S. Pat. No. 4,046,859, the entire contents of which is incorporated herein by reference.

After catalytic dewaxing and hydrotreating the effluent of the hydrotreater is conventionally topped by distillation, i.e., the most volatile components are removed to meet flash and fire point specification.

While the process of the invention is applicable to raffinates produced from a wide range of crude feedstock, the process is especially applicable to heavy neutrals. In order to reduce the loss in yield and VI experienced in prior art catalytic dewaxing of raffinates, smaller pore zeolites, such as zeolites from the ferrierite family (i.e. ZSM-22, -23, -35, -48, -50, -57 & -58) which are more constrained, and thus more selective, have been explored to recapture some of these losses. Although some of these more constrained catalysts perform relatively well with light hydroprocessed feeds, they typically have difficulty in processing non-hydroprocessed or neutral feedstocks and even heavier hydroprocessed feeds. They are generally incapable of processing heavier (>200N) raffinates to useful base stock pour points of 20° F. or lower. The process of the invention is not burdened by such a limitation and, therefore, the economic viability of the use of heavy raffinates is expanded.

After completion of the dewaxing process of the invention a product is recovered that is suitable as a lube base stock except that the pour point is too high. The pour point can be lowered to a temperature that meets specification by mixing pour point depressants (PPDs) with the stock in quantities that usually do not exceed 1 weight percent. Any conventional PPD known in the art can be used to lower the pour point. Examples of suitable conventional PPDs are those based on poly(methylmethacrylate), referred to herein as PMA-PPD. However, the preferred PPDs are those produced by the copolymerization of mixed 1-alkenes in contact with carbon monoxide reduced chromium oxide catalyst on silica support. These copolymer PPDs are referred to herein as OCP-PPDs and are related to the lubricant compositions and process taught in U.S. Pat. Nos. 4,827,064 and 4,827,023.

Recently, novel lubricant compositions (referred to herein as HVI-PAO and the HVI-PAO process) comprising polyalphaolefins and methods for their preparation employing as catalyst reduced chromium on a silica support have been disclosed in foregoing U.S. Pat Nos. 4,827,064 and 4,827,023. These patents are incorporated herein by reference in their entirety. The process comprises contacting $C_6$–$C_{10}$ 1-alkene feedstock with reduced valence state chromium oxide catalyst on porous silica support under oligomerizing conditions in an oligomerization zone whereby high viscosity, high VI liquid hydrocarbon lubricant is produced having low methyl to methylene branch ratios of less than 0.19 and pour point below −15° C. The process is distinctive in that little isomerization of the olefinic bond occurs compared to known oligomerization methods to produce polyalphaolefins using Lewis acid catalyst.

Olefins useful as feedstock in the present invention to prepare the 1-alkene copolymer OCP-PPDs include ethylene and $C_3$–$C_{28}$ 1-alkenes of odd and even carbon number. The preferred olefins are 1-alkenes, i.e., alpha-olefins selected from the group consisting of $C_6$–$C_{24}$ 1-alkenes. The preferred long chain 1-alkenes comprise $C_{14}$–$C_{24}$ α-olefins. The most preferred long chain 1-alkenes comprise $C_{16}$–$C_{20}$ α-olefins.

Feedstocks include mixtures of 1-alkene where the mixture of 1-alkenes comprise at least 10 weight percent $C_{16}$–$C_{24}$ 1-alkenes. The mixture may be a mixture of only two such 1-alkenes, for example, 1-hexene and 1-octadecene, 1-decene and 1-eicosene, or it may be a mixture that includes propylene, 1-butene, 1-pentene, 1-hexene, 1-heptene, 1-octene, 1-nonene, 1-decene, and higher 1-alkenes up to and including $C_{28}$ 1-alkene. In any event, at least 10 weight percent, but preferably 20 weight percent, of the 1-alkenes of the mixture will be 1-alkenes containing 16 to 24 carbon atoms.

The oligomerization reactions to prepare the 1-alkene copolymer PPD are catalyzed by supported metal oxide catalysts, such as Cr compounds on silica or other supported IUPAC Periodic Table Group VIB compounds as described in U.S. Pat. No. 4,827,064 to M. Wu. The catalyst most preferred is a lower valence Group VIB metal oxide on an inert support. Preferred supports include silica, alumina, titania, silica alumina, magnesia and the like. The support material binds the metal oxide catalyst. These pourous supports may be in powder form or in extrudate form. Those porous substrates having a pore opening of at least 40 angstroms are preferred.

The process and compositions of the 1-alkene copolymers PPD used in the present invention are described by illustrating their preparation and properties in the following Example 1.

EXAMPLE 1

Six grams of $Cr/SiO_2$ catalyst prepared as described in U.S. Pat. No. 4,827,064 to M. Wu were mixed with an alpha olefin mixture containing six to twenty carbon numbers and the mixture was stirred at room temperature for twenty-four hours. The alpha olefin mixture has a composition comparable to the alpha olefin mixture produced from a single stage ethylene growth reaction. Gas chromatograph (GC) analysis of the polymer solution produced from the oligomerization reaction of alphaolefins showed that 70% to 90% of the alpha olefins were converted into polymers. The slurry mixture was very thick and 400 cc of xylene was added to dilute and quench the catalyst. The mixed olefin based OCP-PAO polymer was isolated by filtration to remove the catalyst, followed by distillation at 160° C. and 100 millitorr to remove solvent and any unreacted olefins. All of the alphaolefins in the starting mixture were converted into polymer. The residual olefins were internal or branched olefins present in the starting mixture. The polymer had a number average molecular weight of 18,200, weight average molecular weight of 58,000 and molecular weight distribution of 3.19.

The process of the instant invention is specifically illustrated by reference to the following Example 2 and the results as reported in the subsequent Tables and Figures.

EXAMPLE 2

Furfural-extracted Arab Light 700N and Isthmus 100N raffinates were used as feedstocks. The targeted or predetermined VI for the hydrodewaxed stocks were those VIs obtained for these feedstock by normal solvent dewaxing methods. Solvent dewaxing of these raffinates provides 94 VI at 20° F. pour point for the 700N and 102 VI at 15° F. pour point for 100N.

The hydrodewaxing conditions of temperature, LHSV and pressure employed in Example 2 for the raffinates feedstocks and hydrogen where those as described herein before.

The heavy neutral raffinate (700N) was dewaxed with a silica-bound HZSM-5 catalyst to a pour point of 40°–5° F. whereby the basestock yield was 90% and the VI 94. Dewaxing the 700N raffinate with silica-bound HZSM-5 catalyst to 20° F. resulted in an 87% yield of 89 VI basestock at 20° F. pour point. The heavy neutral raffinate (700N) was also dewaxed with an alumina-bound HZSM-5 catalyst to a pour point of 40°–5° F. whereby the base stock yield was 90% and the VI was 94. Dewaxing the 700N raffinate with alumina-bound HZSM-5 catalyst to 20° F. resulted in only an 86% yield of 90 VI base stock at 20° F. pour point. The dewaxing catalysts used for these processes are considered the best available silica- and alumina-bound HZSM-5 catalysts for hydrodewaxing heavy neutral raffinates to normal base stock pour points.

The light neutral raffinate (100N) was dewaxed with a silica-bound HZSM-5 catalyst to a pour point of 40°–5° F., whereby the base stock yield was 86% and the VI was 107. Hydrodewaxing the 100N raffinate to 15° F. resulted in an 80% yield of 102 VI basestock.

Figure 2:
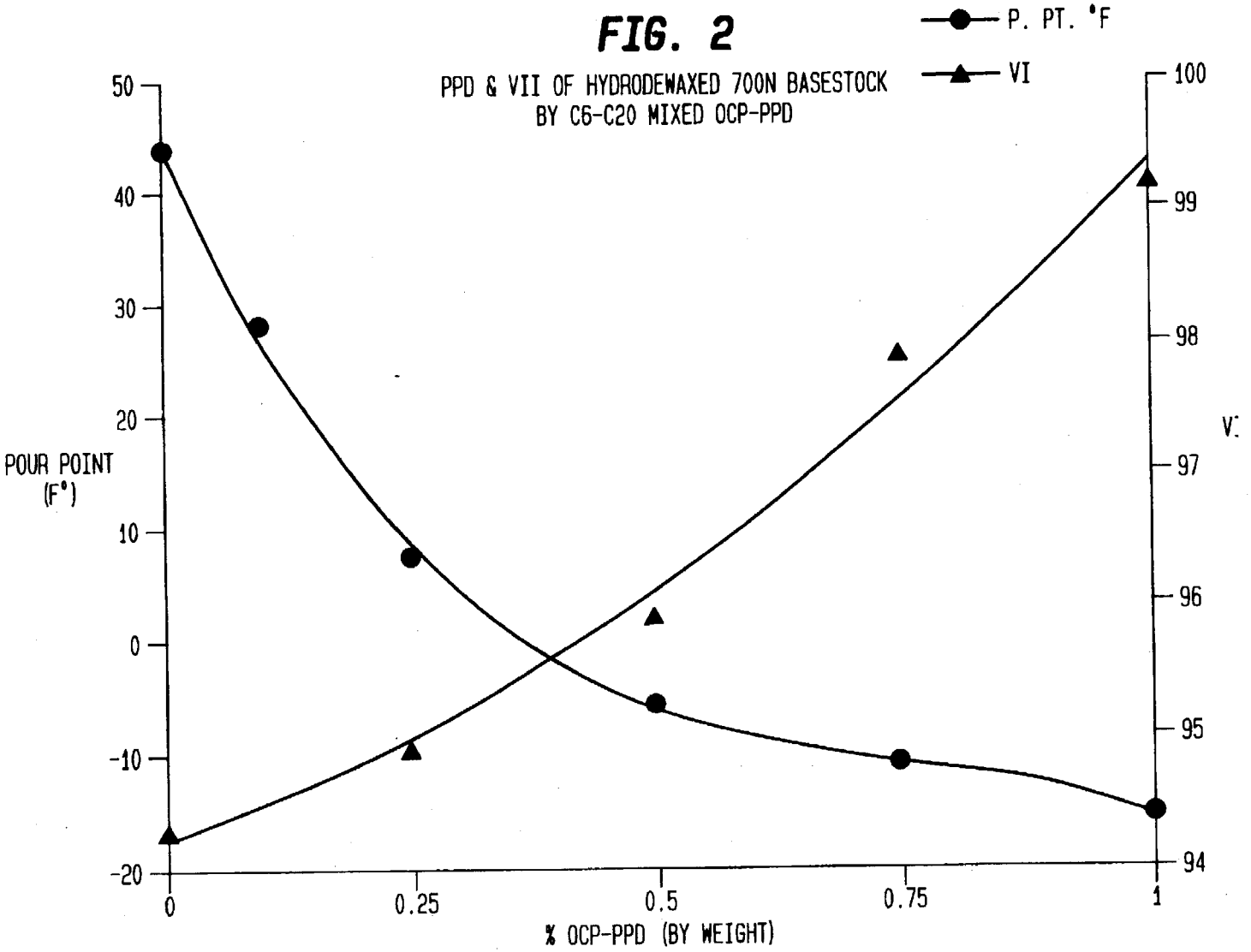
FIG. 2 is graphical presentation of the pour points and viscosity of hydrodewaxed 700N basestock of the invention containing pour points depressants comprising copolymers of mixed $C_6$–$C_{20}$ 1-alkenes.
Figure 3:
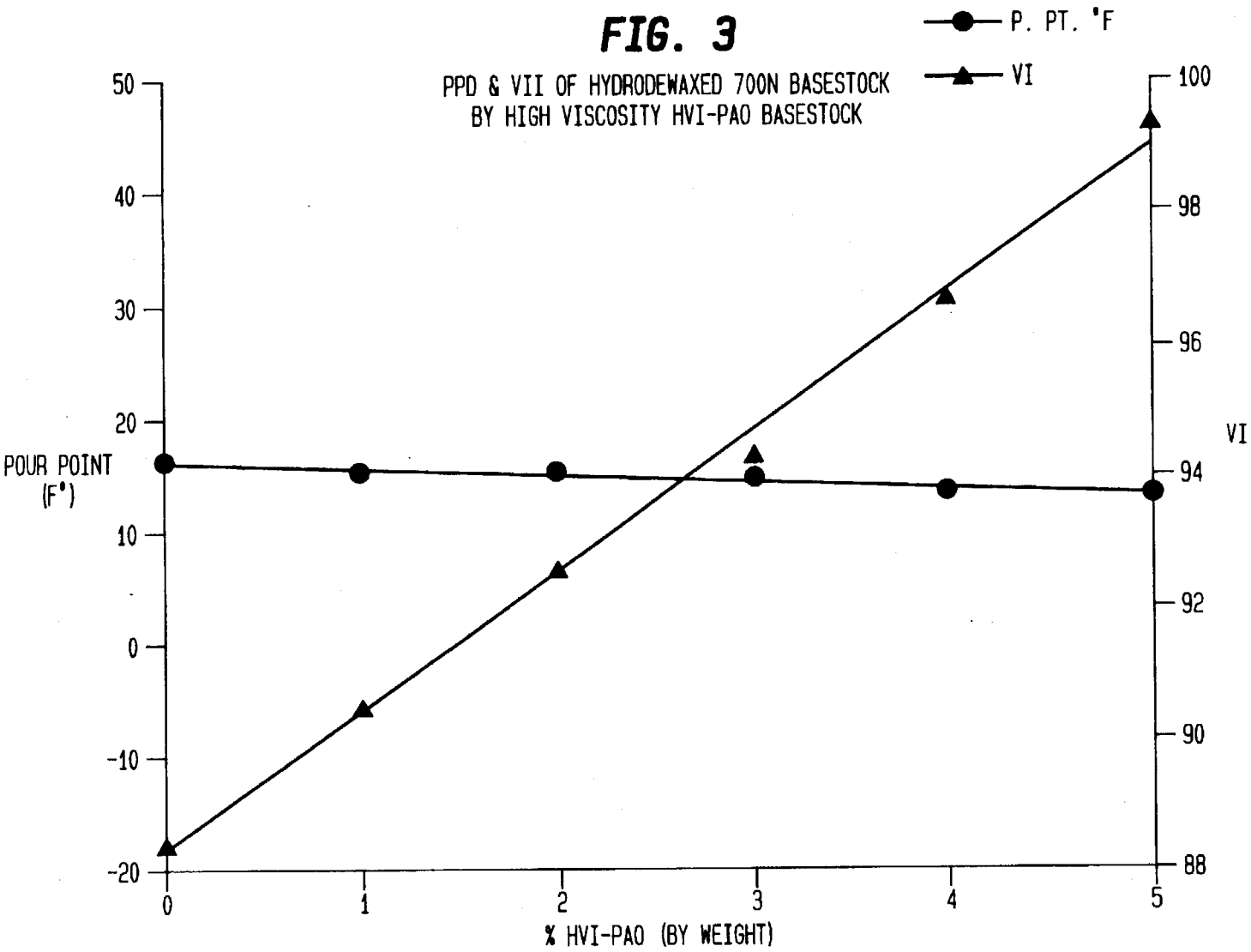
FIG. 3 is graphical presentation of the pour points and viscosity of hydrodewaxed 700N basestock of the invention containing pour points depressants comprising a polymer of $C_6$–$C_{20}$ 1-alkenes, i.e., poly(1-decene).

The pour point depressants (OCP-PPD) were added to these hydrodewaxed stocks in weight concentrations up to 1%. The pour points and VIs of these blends are shown in Table 1 and represented graphically in FIG. 1 for the 100N and FIG. 2 for the 700N produced from the silica-bound bydrodewaxing catalyst. For comparison with these results, a hydrodewaxed sample of 700N of 15°–20° F. and 88–89 VI was blended with 325 cS (@100° C.) HVI-PAO as prepared according to the process described in U.S. Pat. No. 4,827,064 to M. Wu. Concentrations from 1 to 5% by weight, of the HVI-PAO were tested. The pour point depression and VI improvement results for these blends are listed in Table 2 and shown graphically in FIG. 3.

Comparison of the results of the OCP-PPD and HVI-PAO blends show the OCP-PPD can simultaneously and dramatically reduce pour point and provide substantial VI improvement. These OCP-PPD are bi-functional, they not only serve as very good pour point depressants but also simultaneously serve as very good VI improvers in low concentration.

The OCP-PPD were evaluated with the pour point depression results of blends of the 700N and commercially available polymethacrylate pour point depressants (PMA-PPD). They were also studied in combination with commercially available polymethacrylate pour point depressants. The pour point depression results with two different OCP-PPDs are given in Table 3 and 4. The blends containing both the OCP-PPD and the PMA-PPD show substantial synergistic behavior to lower pour point than the two are capable of achieving independently. Very low pour point 700N can be achieved in this way.

These data establish that the process of the invention allows for higher yields of higher VI base stocks to be produced by catalytic dewaxing, sufficient to make up the loss experienced by a conventional hydrodewaxing process, relative to solvent dewaxing. It has been shown that the pour point of the base stock is readily adjustable to a useful low temperature level by adding a small amount of mixed olefin co-polymer pour point depressants (OCP-PPD) which function as a strong pour point depressant (PPD) and also, as an added benefit, as good VI improvers (VII). Use of these OCP-PPD in combination with commercial PMA-PPD allows very low pour points to be reached by a synergistic effect.

TABLE 1

P. Pt. Depression & VI Improvement of High-Pour Hydrodewaxed Stocks W/ Mixed Olefin Co-Polymer (OCP-PPD)
OCP-PPD:C6-C20 Mixed Oligomer (Blended by Weight)

| Isthmus 100N | P./PT. | Kinematic Viscosity | | |
|---|---|---|---|---|
| Stk 483 | (°F.) | cS @ 40° C. | cS @ 100° C. | VI |
| NEAT | 42.8 | 17.81 | 3.850 | 107.4 |
| w/ 0.10% OCP-PPD | 32.4 | | | |
| w/ 0.25% OCP-PPD | 20.5 | 18.40 | 3.940 | 108.9 |
| w/ 0.50% OCP-PPD | −2.4 | | | |
| w/ 0.75% OCP-PPD | −2.7 | 19.36 | 4.119 | 114.0 |
| w/ 1.00% OCP-PPD | −7.4 | | | |
| **Arab Light 700N Stk 339** | **P. PT. (°F.)** | **CS 40° C.** | **CS 100° C.** | **VI** |
| NEAT | 43.7 | 129.32 | 13.11 | 94.3 |
| w/ 0.25% OCP-PPD | 28.2 | 131.42 | 13.29 | 94.9 |
| w/ 0.50% OCP-PPD | 7.5 | 134.32 | 13.56 | 95.9 |
| w/ 0.75% OCC-PPD | −10.7 | 136.75 | 13.91 | 97.9 |
| w/ 1.00% OCC-PPD | −15.3 | 138.95 | 14.17 | 99.2 |

TABLE 2

P. Pt. Depression & VI Improvement of Normal-Pour Hydrodewaxed Stocks w/ HVI-PAO
HVI-PAO: 325 cS @ 100° C. (Blended by Weight)

| Arab Light 700N | P. PT. (°F.) | Kinematic Viscosity cS @ 40° C. | cS @ 100° C. | VI |
|---|---|---|---|---|
| NEAT | 16.2 | 143.29 | 13.57 | 88.4 |
| w/ 1.00% HVI-PAO | 15.3 | 147.72 | 14.01 | 90.5 |
| w/ 2.00% HVI-PAO | 15.3 | 152.56 | 14.50 | 92.6 |
| w/ 3.00% HVI-PAO | 14.9 | 159.94 | 15.08 | 93.9 |
| w/ 4.00% HVI-PAO | 13.5 | 164.65 | 15.62 | 96.7 |
| w/ 5.00% HVI-PAO | 13.3 | 170.63 | 16.31 | 99.3 |

TABLE 3

P. Pt. Depression of 40° F. Pour Hydrodewaxed 700N Stock w/ PPDs
OCP-PPD: C6-C20 Mixed Olefin Co-Polymer PPD
PMA-PPD: Polymethacrylate PPD (Concentration in Oil)

| | Herzog Pour Points in °F. PMA-PPD (% by Weight of Concentrate) | | | | | |
|---|---|---|---|---|---|---|
| OCP-PPD | NEAT | 0.20% | 0.35% | 0.50% | 0.75% | 1.00% |
| NEAT | 40 | 13 | 7 | 2 | −4 | −6 |
| 0.25% | 13 | −8 | −9 | −10 | | |
| 0.50% | 7 | | | −10 | | |
| 0.75% | −5 | −12 | −15 | −14 | | |
| 1.00% | −2 | | | | | |

TABLE 4

P. Pt. Depression of 40° F. Pour Hydrodewaxed 700N Stock w/PPDs
OCP-PPD: C6, C16, C18, C20 Mixed Olefin Co-Polymer PPD
PMA-PPD: Polymethacrylate PPD (Concentrate in Oil)

| | Herzog Pour Points in °F. PMA-PPD (% by Weight of Concentrate) | | | | | |
|---|---|---|---|---|---|---|
| OCP-PPD | NEAT | 0.20% | 0.35% | 0.50% | 0.75% | 1.00% |
| NEAT | 40 | 13 | 7 | 2 | −4 | −6 |
| 0.25% | 26 | 6 | | −8 | | |
| 0.50% | 9 | | | −11 | | |
| 0.75% | 8 | −11 | | −13 | | |
| 1.00% | 7 | | | | | |

Table 5 depicts the results achieved by dewaxing three neutral oil lube stocks to a target VI and then lowering the pour point with increased VI by the addition of OCP-PPD copolymers. A forty degree to fifty-five degree reduction in pour point is realized, depending on the viscosity of the stock, by adding between 0.5 to 1 weight percent of OCP-PPD oilgomers as PPD; plus, the product realizes an increase in viscosity index.

TABLE 5

| Oil Visc. | Unadditivated Oil (−PPD) | | Additivated Oil (+PPD) | | |
|---|---|---|---|---|---|
| SUS @ 40° C. | VI | Pour Pt. | VI | Pour Pt. | Wt. % |
| 100–250 | 95 | 10° F. | 100 | −45° F. | 0.5 |
| 250–500 | 97 | 20° F. | 102 | −35° F. | |
| 500–750 | 90 | 20° F. | 95 | −20° F. | 1.0 |

What is claimed is:

1. A catalytic hydrodewaxing pour point temperature reduction process for producing liquid hydrocarbon lubricant base stock from waxy, high viscosity index hydrocarbon feedstock in improved yield and viscosity index over solvent dewaxing pour point reduction methods, said process comprising:

contacting a feedstream comprising hydrogen and said feedstock with shape selective metallosilicate catalyst particles in a catalytic hydrodewaxing zone under hydrodewaxing conditions controlled to produce said base stock having said improved viscosity index and yield, wherein said process is ended when said feedstock high viscosity index is lowered to not less than 90 without regard to the base stock pour point temperature produced, whereby said base stock is produced at a yield of at least 80 weight percent; and mixing pour point depressant additive into said base stock to lower the pour point temperature of said base stock.

2. The process of claim 1 wherein said additive comprises the copolymer residue of a mixture of 1-alkene comonomers selected from the group consisting of $C_3$–$C_{28}$ 1-alkenes, wherein said copolymer contains at least 10 weight percent of recurring monomeric units of $C_{14}$–$C_{24}$ 1-alkenes; has a number average molecular weight between 5,000 and 60,000; and has a molecular weight distribution between 1 and 10.

3. The process of claim 2 wherein said mixture of 1-alkenes comprises a bimodal mixture of $C_6$–$C_{24}$ 1-alkenes.

4. The process of claim 2 wherein said mixture comprises the copolymer of 1-decene and 1-octadecene.

5. The process of claim 1 wherein said pour point depressant additive comprises polymethacrylate.

6. The process of claim 1 wherein said feedstock comprises a heavy neutral raffinate.

7. The process of claim 1 wherein said feedstock comprises a light neutral raffinate.

8. The process of claim 2 wherein said additive comprises a mixture of said copolymer residue and polymethacrylate.

* * * * *